US011643308B2

(12) United States Patent
DeMaria

(10) Patent No.: US 11,643,308 B2
(45) Date of Patent: May 9, 2023

(54) DRIVE SHAFT REMOVAL TOOL

(71) Applicant: John P. DeMaria, Johns Island, SC (US)

(72) Inventor: John P. DeMaria, Johns Island, SC (US)

( * ) Notice: Subject to any disclaimer, the term of this patent is extended or adjusted under 35 U.S.C. 154(b) by 160 days.

(21) Appl. No.: 17/206,583

(22) Filed: Mar. 19, 2021

(65) Prior Publication Data

US 2021/0292140 A1 Sep. 23, 2021

Related U.S. Application Data

(60) Provisional application No. 62/991,666, filed on Mar. 19, 2020.

(51) Int. Cl.
*B66F 3/00* (2006.01)
*B63B 81/00* (2020.01)

(52) U.S. Cl.
CPC ..... *B66F 3/00* (2013.01); *B63B 81/00* (2020.01)

(58) Field of Classification Search
CPC ..... B66F 13/00; B66F 2700/05; B66F 2700/052; B66F 2700/09; B66F 3/00; B66F 3/25; B25B 27/0035; B25B 27/026; Y10T 29/53796; Y10T 29/5383; Y10T 29/53878; Y10T 29/53883; Y10T 29/53983; Y10T 29/53991; B63B 81/00
USPC ..... 29/426.5, 444, 251, 252, 255, 263, 272, 29/278, 282
See application file for complete search history.

(56) References Cited

U.S. PATENT DOCUMENTS 2,561,577 A * 7/1951 Knudsen ..... B25B 27/026 173/132
2,742,257 A 4/1956 Hott et al.
3,972,491 A 8/1976 Ferris et al.
5,207,306 A 5/1993 Sato et al.
(Continued)

FOREIGN PATENT DOCUMENTS

CN 108687712 A * 10/2018 ..... B25B 27/026
WO WO1996015977 11/1995

OTHER PUBLICATIONS

CN108687712—Machine Translation (Year: 2018).*
(Continued)

*Primary Examiner* — Monica S Carter
*Assistant Examiner* — Alberto Saenz
(74) *Attorney, Agent, or Firm* — Kim and Lahey Law Firm, LLC; Hunter Freeman

(57) ABSTRACT

The present invention relates to a tool for removing drive shafts from transmissions. In at least one embodiment, the present invention may remove a propeller shaft from an outboard engine. The present invention includes a upper housing, a lower housing and an inner guide conduit system, a portion of each define a jack support chamber and a viewing chamber, wherein the jack support chamber is adapted to house a hollow body jack and the viewing chamber is adapted to provide a view of the shaft while being removed from the shaft housing. One embodiment further includes an extension rod that may be secured at a first end to the drive shaft and secured at a second end to a piston of a hollow body jack so that when actuated the jack will remove the shaft from the shaft housing without damaging the engine or the gear housing.

18 Claims, 9 Drawing Sheets

(56) References Cited

U.S. PATENT DOCUMENTS

| | | | | |
|---|---|---|---|---|
| 2004/0088844 | A1* | 5/2004 | Klann | B25B 27/18 29/263 |
| 2019/0135243 | A1 | 5/2019 | Righetti | |

OTHER PUBLICATIONS

Krishnamoorthi, T., et al., Removal of Dry Type Liner from the Engine Block by Using Hydraulic Operation, Intern'l Journal of Eng. Research & Tech., 2017, vol. 5, Issue 7.

* cited by examiner

DRIVE SHAFT REMOVAL TOOL

BACKGROUND OF THE INVENTION

1) Field of the Invention

The present invention relates to a tool for removing drive shafts such as a propeller shaft for an outboard engine, which is also occasionally referred to as a marine outdrive. While discussed in relation to the removal of a propeller shaft from a marine outdrive, the present invention and/or embodiments thereof, could be used to remove drive shafts from other types of engines too. Therefore, the terms "drive shaft" and "propeller shaft" may be used interchangeably as too may the terms "gear housing" "transmission housing" and/or "shaft housing."

2) Description of Related Art

From time to time propeller shafts for a marine outdrive need to be removed for replacement, cleaning and/or maintenance purposes. Given that the marine outdrive is in contact with saltwater, a salt buildup develops at the seal and/or connection point where the propeller shaft is inserted into the shaft housing. The salt buildup acts as a binding agent making the removal of the propeller shaft very difficult.

Prior art tools typically use a manual pulling force to remove the propeller shaft. One such prior art device uses a slide hammer to create the pulling force, while other prior art devices use manual screw type jacks, which are attached to the propeller shaft by chains, wire, rope or the like. These prior art tools seldom provide a sufficient pulling force to break the bond between the propeller shaft and the shaft housing that is caused by the salt buildup. Therefore, these prior art devices often require the use of a hand held torch that is used to heat the shaft housing so as to cause expansion and, thus, breaking the bond caused by the salt buildup.

Use of such a torch or other heat source is not only dangerous to the user, it can damage the shaft housing. Repeated heating and cooling of the shaft housing is likely to weaken the housing over time. Moreover, it is often necessary to heat the shaft housing to a very high temperature to allow the metal to sufficiently expand and break the bond. Also, these prior art devices take an undesirable amount of time to remove the propeller shaft because they must first heat the shaft housing to a high temperature, which can take a long time when using a hand torch.

Accordingly, it is an object of the present invention to provide a device that can quickly and safely remove a drive shaft from the shaft housing.

It is another objective to provide a device that can remove a drive shaft from the shaft housing without requiring the user of the device to exert any pulling force personally.

It is another objective to provide a device that can remove a drive shaft from the shaft housing without requiring the use of a heat source.

It is another objective to provide a device that can be quickly mounted on and/or dismounted from the drive shaft to be removed.

SUMMARY OF THE INVENTION

The above objectives are accomplished according to the present invention by providing An apparatus for removing a shaft from a transmission comprising: a lower housing having a first end and a second end, wherein said lower housing includes an inner surface having an inner diameter and an outer surface having an outer diameter; an upper housing having a first end and a second end, wherein said second end of said upper housing is carried by said first end of said lower housing and said first end of said upper housing defines a jack opening; an inner guide conduit system carried by said inner surface of said lower housing, wherein said inner guide conduit system comprises: a central conduit and a support member having a first end that is carried by said central conduit and a second end that is carried by said inner surface of said lower housing; a jack support chamber that is adapted to house a hollow body jack and is defined by at least a portion said upper chamber, a portion of said lower chamber and a portion of said inner guide conduit system such that at least a portion of said upper chamber is adjacent the hollow body jack's upper surface, at least a portion of said lower chamber is adjacent to the hollow body jack's outer surface and at least a portion of said inner guide conduit is adjacent to the hollow body jack's lower surface; a viewing chamber that disposed below said jack support chamber and is defined by at least a portion of said lower housing and at least a portion of said inner guide conduit system, wherein at least a portion of said lower housing includes a viewing window to provide access to said viewing chamber; an extension rod that is adapted to be received by said jack opening in said upper housing and by said central conduit; a shaft coupler that is adapted to receive and secure a first end of said extension rod to a drive shaft; and, a shaft securing member that is adapted to receive and secure a second end of said extension rod to a piston of the hollow body jack.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
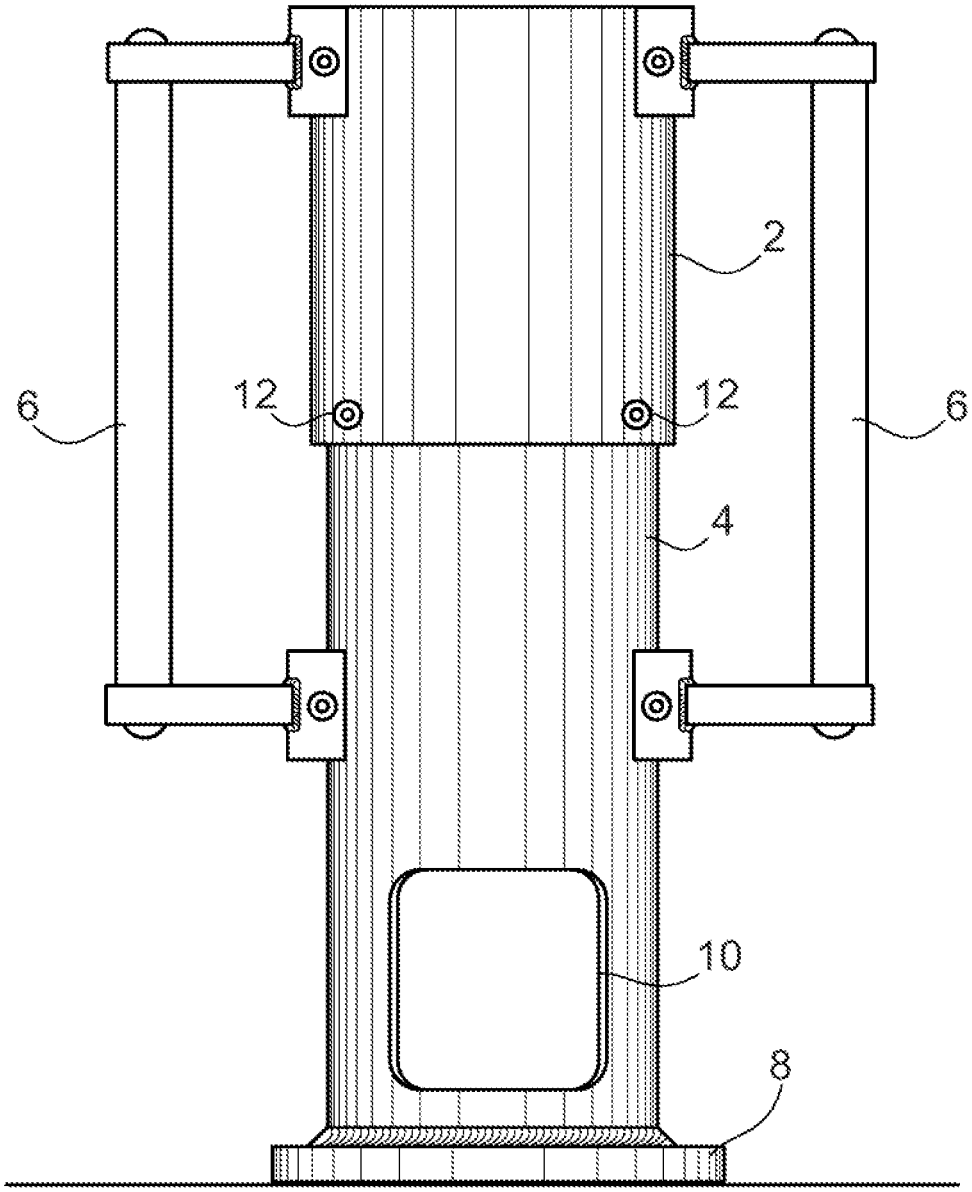
FIG. 1 shows a front elevation view of an embodiment of the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objectives can be viewed in the alternative with respect to any one aspect of this invention. These and other objectives and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objectives, features, benefits and advantages of the present invention will be apparent from this summary and certain embodiments described below, and will be readily apparent to those skilled in the art. Such objectives, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As a final matter, specific dimensions for various parts or aspects of the present invention, or embodiments thereof, may be provided. It will be understood however, that these dimensions are provided for illustrative purposes only and that dimensions could vary depending on the needs of the user, the task to be performed and/or the embodiment of the present invention being used. For example, depending on the size of the shaft to be removed, the transmission in which the shaft is housed and/or the size of the jack to be housed in the present invention, all diameters and dimensions disclosed herein could vary.

Referring now to FIGS. 1-4, an embodiment of the present invention includes an upper housing 2, a lower housing 4, a first and second handle 6 and a base 8. The shown embodiment further includes a viewing window 10. As can be seen, a lower end 2*b* of the upper housing 2 may be attached to an upper end 4*a* of the lower housing 4 by means of fasteners such at the depicted bolts 12. In alternate embodiments, however, the upper housing may be attached to the lower housing by any means generally known. It is preferable to attach the upper housing to the lower housing in a removable fashion. The shown embodiment of the present invention further incudes a base 8 that is attached to a lower end of the lower housing. In the shown embodiment, the base 8 is permanently affixed by means of welding. In alternate embodiments, the base could be integrally formed as part of the lower housing 4 or alternatively could be removably attached by means generally known in the art.

Referring now to FIGS. 3A-D, the lower housing can be more clearly seen. The lower housing includes a first end 4*a*, which is also referred to as the upper end, and a second end 4*b*, which is also referred to as the lower end. In the shown embodiment, the lower housing 4 has a cylindrical shape that has an inner surface 7 having an inner diameter 14 and an outer surface 9 having an outer diameter 16. In the shown embodiment, the viewing window 10 is disposed in the lower housing that is adjacent to the second or lower end 4*b*. In the shown embodiment, the viewing window is generally square shaped but in alternate embodiments, the viewing window could be located anywhere on the lower housing and could have any number of shapes or sizes. In at least one embodiment, the lower housing includes a light source that will illuminate the area inside of the viewing window to aid the user's vision.

The lower housing 4 further includes a notch 18 disposed in the first or upper end 4*a* that extends downwardly towards the second or lower end 4*b*. In the shown embodiment, this notch 18 is generally U shaped and has a width of approximately 0.7 inches and a length of approximately 2.3 inches. As will be discussed in association with FIGS. 4A-E below, this lower housing notch 18 corresponds to a similar notch disposed in the upper housing.

Referring now to FIGS. 4A-E, the upper housing 2 will be discussed in further detail. The upper housing includes a first end 2*a*, which is also referred to as the upper end, and a second end 2*b*, which is also referred to as a lower end. In the shown embodiment, the upper housing 2 has a generally cylindrical cross sectional shape, having an inner surface 5 with an inner diameter 24 and an outer surface 3 having an outer diameter 26. In at least one embodiment, the inner diameter 24 is slightly greater than the lower housing's outer diameter 16 so that the upper housing's lower end 2*b* may slide over the lower housing's upper end 4*b*. Once in place, the upper housing 2 may be secured to the lower housing 4 by means of fasteners 12, clamps or any other means generally known in the art.

Figure 2:
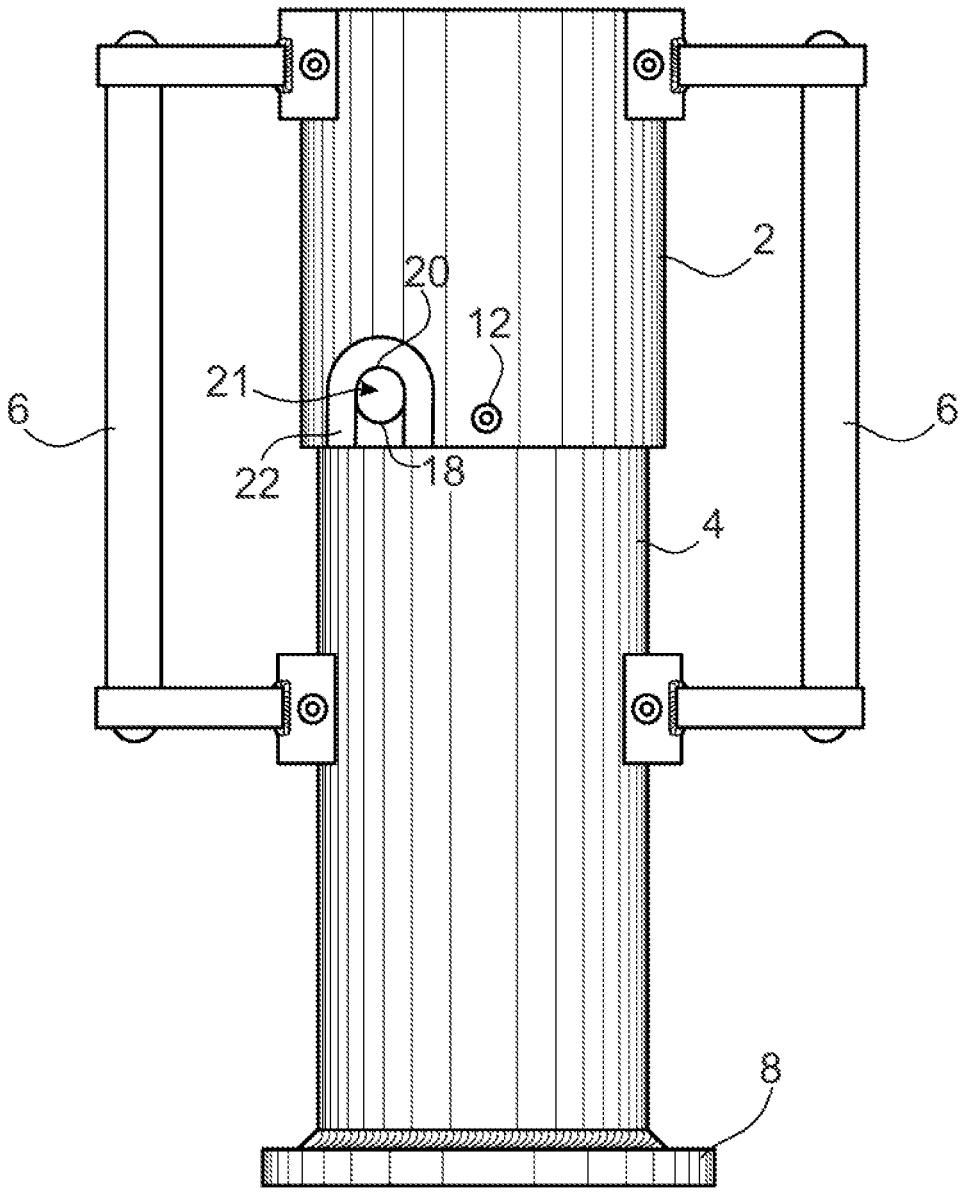
FIG. 2 shows a rear elevation view of an embodiment of the present invention.
Figure 3B:
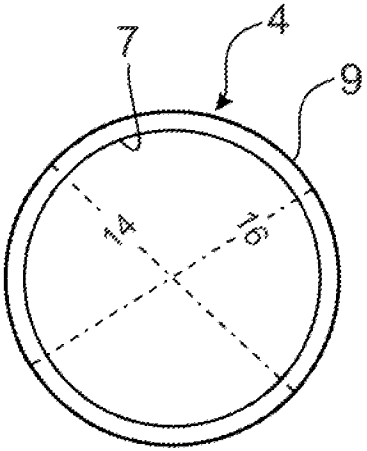
FIG. 3B shows a top plan view of the lower housing of an embodiment of the present invention.
Figure 3A:
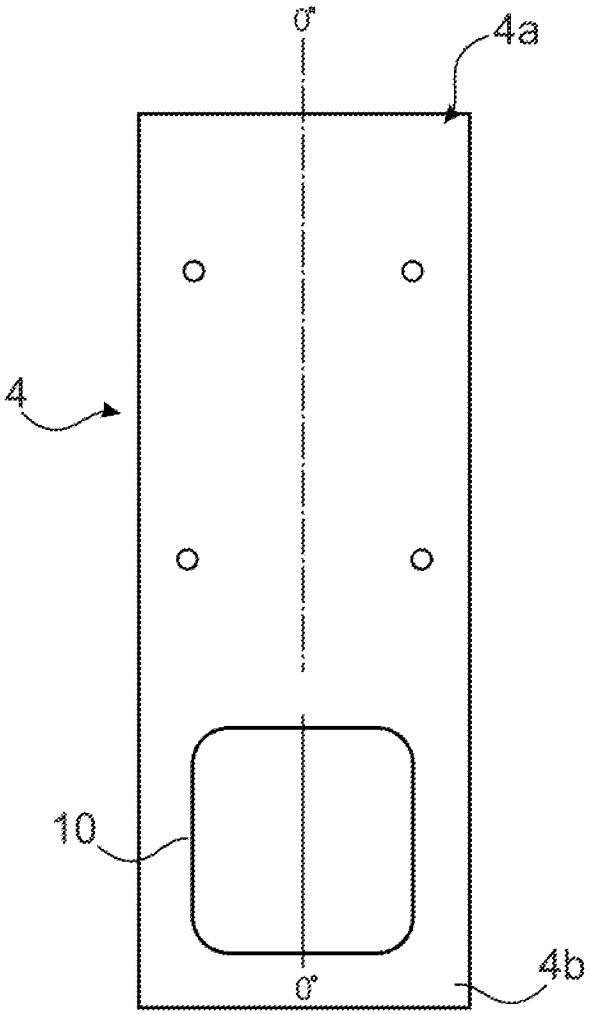
FIG. 3A shows a front elevation of the lower housing of an embodiment of the present invention.
Figure 3D:
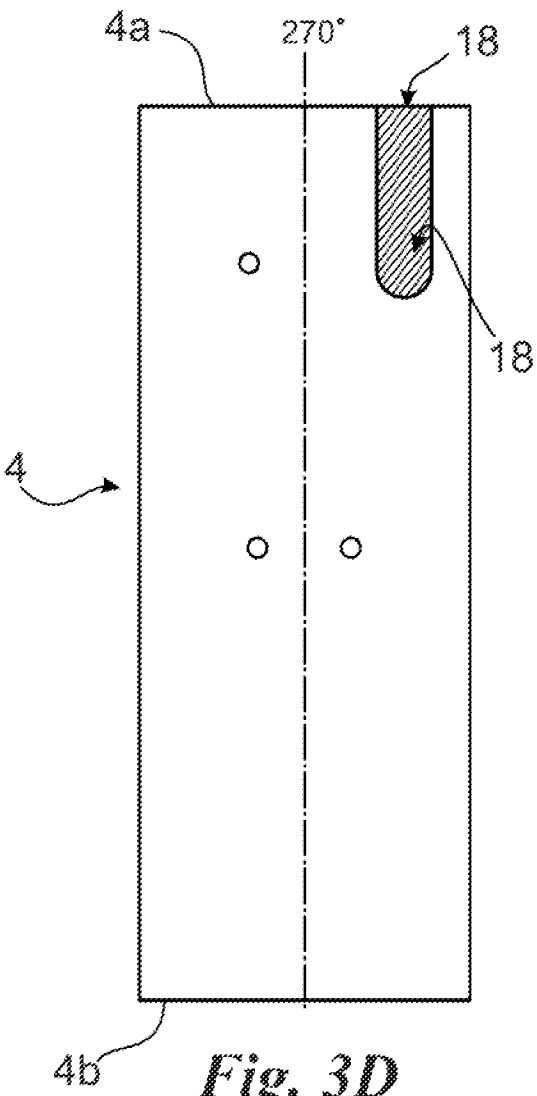
FIG. 3D shows a right side elevation view of the lower housing of an embodiment of the present invention.
Figure 3C:
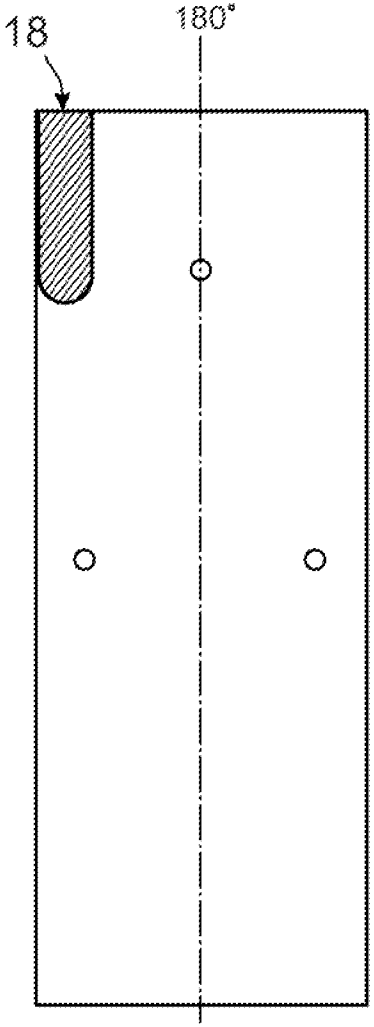
FIG. 3C shows a rear elevation view of the lower housing of an embodiment of the present invention.
Figure 4C:
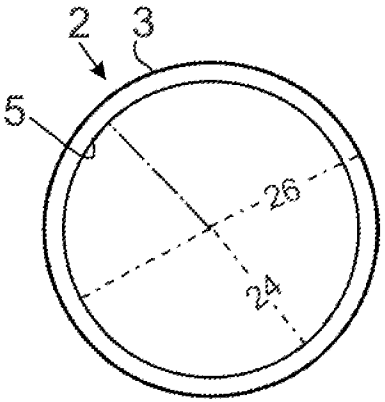
FIG. 4C shows a top plan view of the upper housing of an embodiment of the present invention.
Figure 4E:
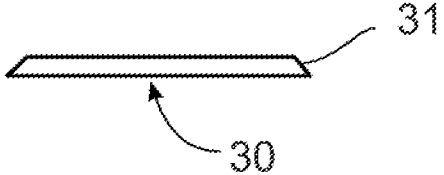
FIG. 4E shows a side elevation view of the upper housing cap of an embodiment of the present invention.
Figure 4B:
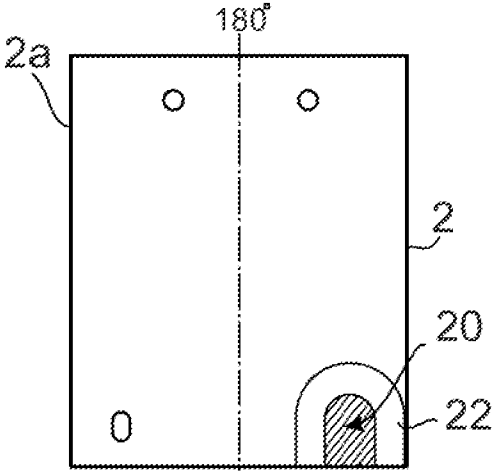
FIG. 4B shows a rear elevation view of the upper housing of an embodiment of the present invention.
Figure 4D:
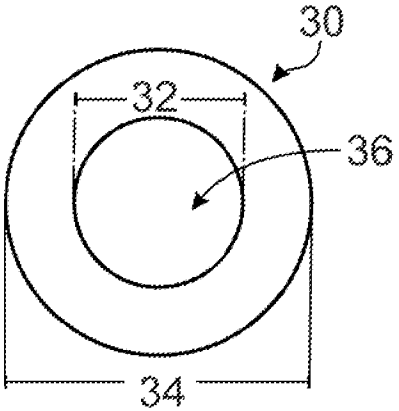
FIG. 4D shows a top plan view of the upper housing cap of an embodiment of the present invention.
Figure 4A:
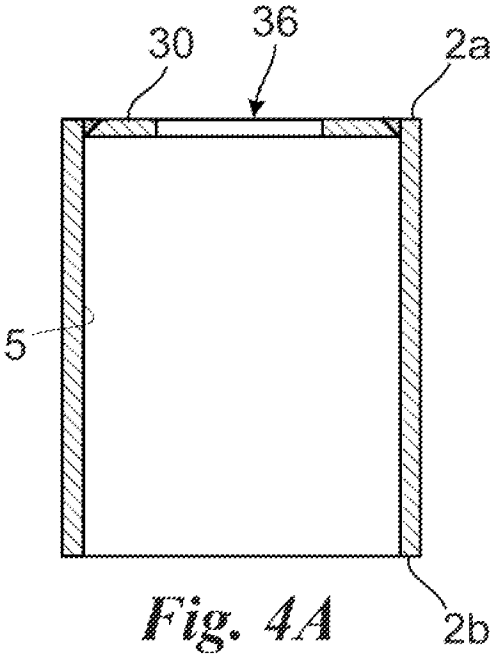
FIG. 4A shows a cross section view of the upper housing of an embodiment of the present invention.
Figure 5C:
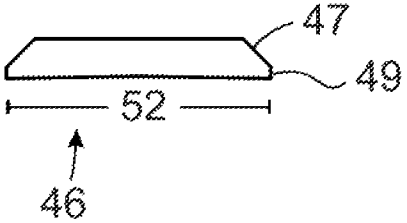
FIG. 5C shows a side elevation view of a support member of an embodiment of the present invention.
Figure 5B:
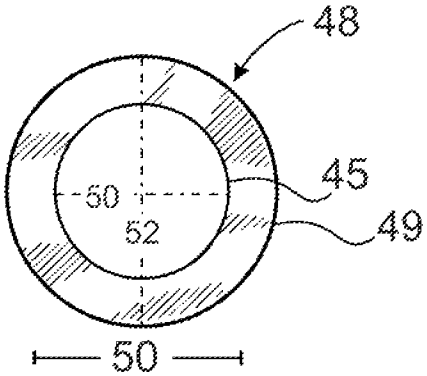
FIG. 5B shows a top plan of a support member of an embodiment of the present invention.
Figure 5A:
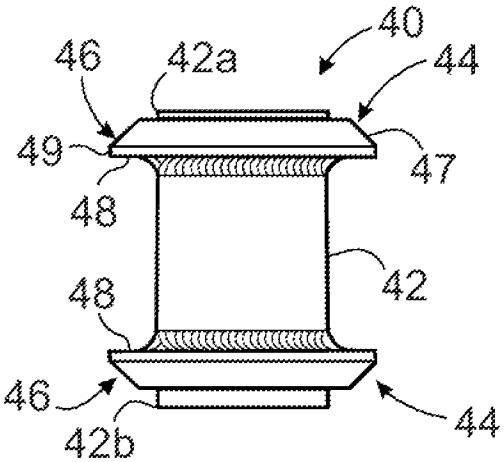
FIG. 5A shows an elevation view of a guide conduit of an embodiment of the present invention.

The upper housing 2 includes a notch 20 that is defined in the lower end 2*b* and extends upwardly towards the upper end 2*a*. Like the lower housing notch 18, the upper housing notch 20 may have any shape that is generally known, including a U shape. Preferably, but not necessarily, the shape of the upper housing notch 20 and the lower housing notch 18 will be the same. In the shown embodiment, the upper housing notch 20 has a width of approximately 0.60 inches and a length of approximately 0.8 inches. As can be seen in FIG. 2, when the upper housing 2 is placed on and secured to the lower housing 4, the upper housing notch 20 slides over the lower housing notch 18 to form an access port 21 that can be used to insert a power source, which can comprise a hydraulic hose or an electric cord (neither shown) that can be connected to the hollow body jack (No. 61 in FIG. 8) that is housed in the lower housing 4. Thus, the exact dimensions of the upper housing notch 20 and lower housing notch 18 can vary to provide the access port 40 with dimensions that are sufficient to accommodate the size of the hose (not shown) being used to power the hollow body jack.

In one embodiment, the upper housing 2 includes a generally flat surface 22 that is formed in the upper housing's outer surface 3 at a point that is adjacent to and surrounding the upper housing notch 20. This flat surface 22 allows the hydraulic hose to be inserted into the access port 21 without interference from the outer surface 3. In the shown embodiment, the flat surface surrounds each of the edges of the notch. In alternate embodiments, however, the flat surface 22 need not surround the entirety of the notch but could instead simply surround portions thereof such as along the lengths of the notch that extend from the lower end 2*b* towards the upper end 2*a*.

In at least one embodiment, the upper housing further includes a cap 30. As shown, the cap has an inner diameter 32 and an outer diameter 34. In one embodiment, the inner diameter is approximately 2.5 inches and the outer diameter is approximately 4.5 inches. The cap may be secured to the upper housing's upper end 2*a* by permanent or removable means. In the embodiment shown in FIG. 4A, the cap 30 is welded to the inner surface 5 at a point that is adjacent to the upper housing's upper end 2*a*. In alternate embodiments, however, the inner surface 5 and the cap 30 could be provided with corresponding threading to allow the cap to be screwed onto the upper housing's upper end 2*a*. The cap serves as the upper surface of the upper housing 2 while the inner diameter 32 forms a jack opening 36 that is adapted to allow the piston of the hollow body jack (shown as 66 in FIGS. 8-9) to rise above the cap and/or to retract below the cap as the jack is actuated to remove the propeller shaft.

Referring now to FIGS. 5A-C and 6, the inner guide conduit system 40 is shown. The guide support conduit system 40 comprises a central conduit member 42 and at least one support member 44. In the shown embodiment, the support member 44 has a first end 45 that extends around the entire circumference of the central conduit 42 and second end 49 that is carried by the lower housing 4. In the shown embodiment, the support member has a frustroconical cross sectional shape. In alternate embodiments, the support member may be disposed on or around only a portion of the central conduit 42 and may have any number of shapes. In one embodiment the support member 44 comprises two separate members—an outer support member 46 and an inner support member 48. In this embodiment, the outer and inner support members are disposed along the central conduit member 42 such that the outer support members are located adjacent to the ends 42*a-b* of the central conduit and the inner support members are located closer to the midpoint of the central conduit. In alternate embodiments, the support member 44 could be a single member.

In the shown embodiment, the support member 44 is disposed on the central conduit 42 such that the support member's inner diameter 50 is located closer to the end 42*a* of the central conduit 42 than the outer diameter 52 is. While not necessary, this arrangement is preferable because the support member's angled surface 47 provides a surface that may be easily welded to the inner surface 5 of the upper housing 2. In the shown embodiment, the present invention includes two support members for additional stability. In this embodiment, the support members are generally disposed adjacent to the ends 42*a-b* of the central conduit. In alternate embodiments, however, any number of support members that are spaced at any point along the length of the central conduit may be used. In the shown embodiment the second end 49 of the support member 44 is carried by the lower housing's inner surface 7.

Figure 7B:
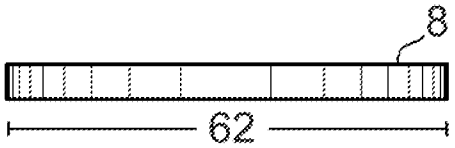
FIG. 7B shows a side elevation view of a base for an embodiment of the present invention.
Figure 7A:
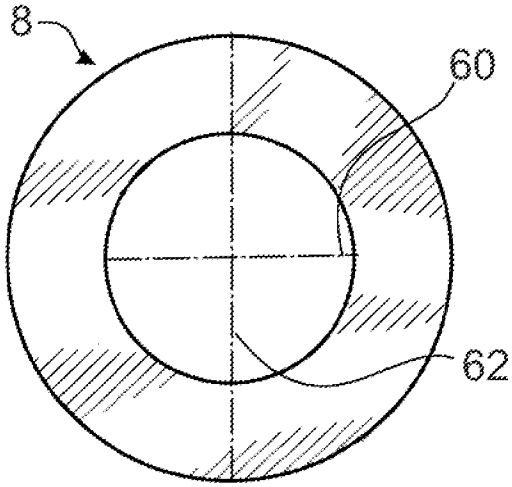
FIG. 7A shows a top plan view of the base for an embodiment of the present invention.
Figure 6:
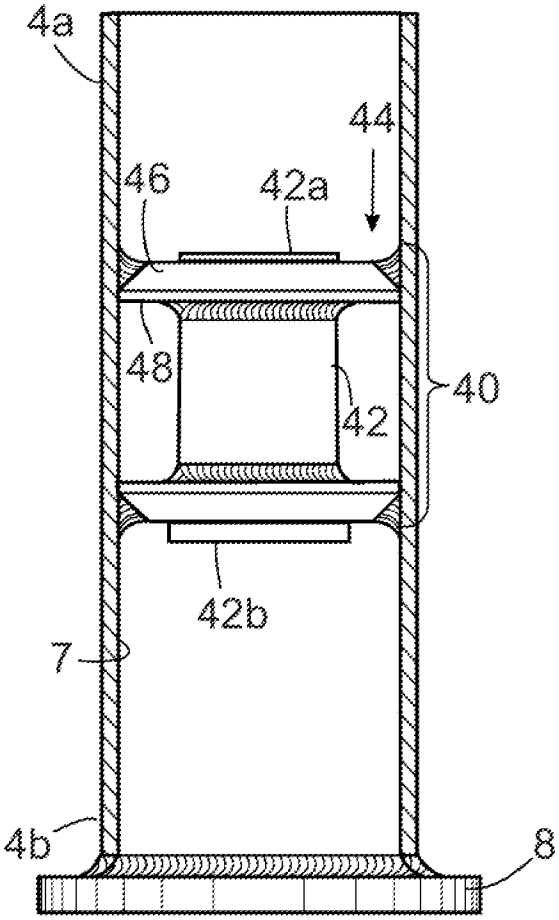
FIG. 6 shows a cross sectional view of an embodiment of the present invention.

Referring now to FIGS. 7A-B, the base 8 may be more clearly seen. In the shown embodiment, the base 8 comprises a ring shaped disc having an inner diameter 60 which forms a base opening and an outer diameter 62. In this embodiment, the inner diameter is preferably, but not necessarily, the same as the inner diameter 14 of the lower housing's lower end 4*b*. In alternate embodiments, the base's inner diameter 60 can be greater or less than that of the lower housing's lower end 4*b*. In the shown embodiment the base's outer diameter 62 is greater than the outer diameter 16 of the lower housing's lower end 4*b*, such that the base provides additional stability and support and distribute more evenly the amount of force that the present invention exerts on the shaft housing from which the shaft is being removed. In the shown embodiment the base 8 is permanently attached to the lower housing's lower end 4*b*. In alternate embodiments, however, the base could be integral with the lower housing or removably attached thereto by generally known means.

Figure 8:
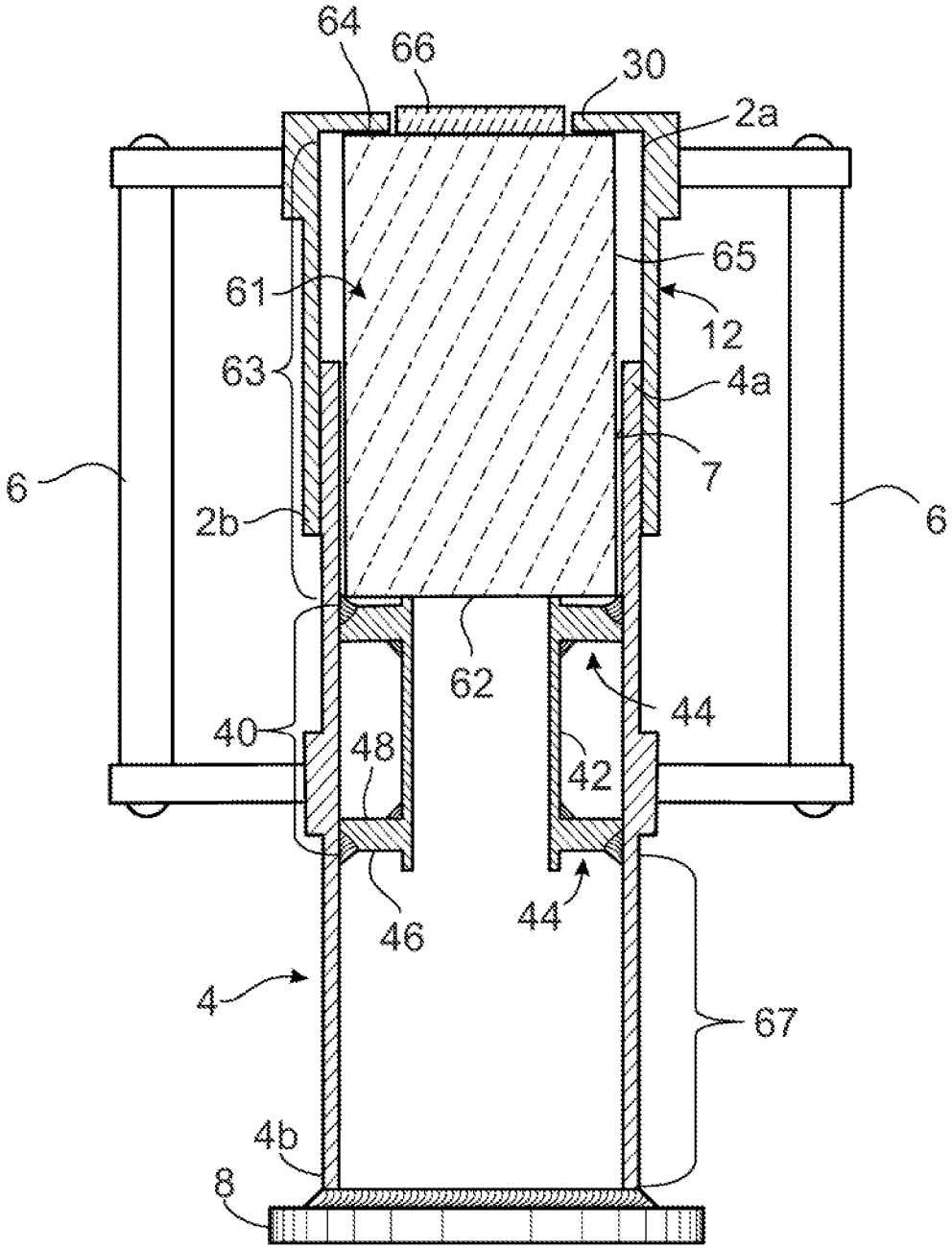
FIG. 8 shows a cross sectional view of an embodiment of the present invention.

Referring now to FIG. 8, a cross sectional view of a fully assembled embodiment of the present invention can be seen. A hollow bodied jack 61 may be placed into the jack chamber 63, which is defined by a portion of the upper housing 2, a portion of the lower housing 4 and a portion of the upper end of the inner guide conduit system 40. When the jack 61 is placed in the upper end 4*a* of the lower housing 4, the jack's lower surface 62 is supported by the inner guide conduit system 40. Preferably, but not necessarily, the inner diameter 14 of the lower housing is just slightly larger than the diameter of the jack such that there is very little room for the jack 61 to shift once placed in the lower housing 4. Once the jack is in place, the lower end 2*b* of the upper housing 2 may slide over top of the lower housing's upper end 4*a*. Preferably, but not necessarily, the dimensions of the upper housing are such that once the upper housing 2 is secured to the lower housing 4, the cap 30 will contact or be adjacent to the jack's upper surface 64. In this embodiment both the upper housing and the lower housing prevent the jack from shifting positions while enclosed in the present invention. Preferably, but not necessarily, the inner diameter 14 of the lower housing 4 is such that the lower housing's inner surface 7 is in contact with or adjacent to the outer surface 65 of the jack 61. As previously discussed, the cap's inner diameter 32 forms a jack opening 36 that allows the jack's piston 66 to rise and fall while in use.

A viewing chamber 67 is defined by at least a portion of the lower housing 4 and a portion of the inner guide conduit system 40. Access to the viewing chamber is provided by the viewing window 10 that is defined in the lower housing 4 so that the end user may view the shaft 80 being removed as well as physically manipulate the shaft to be removed.

Figure 9:
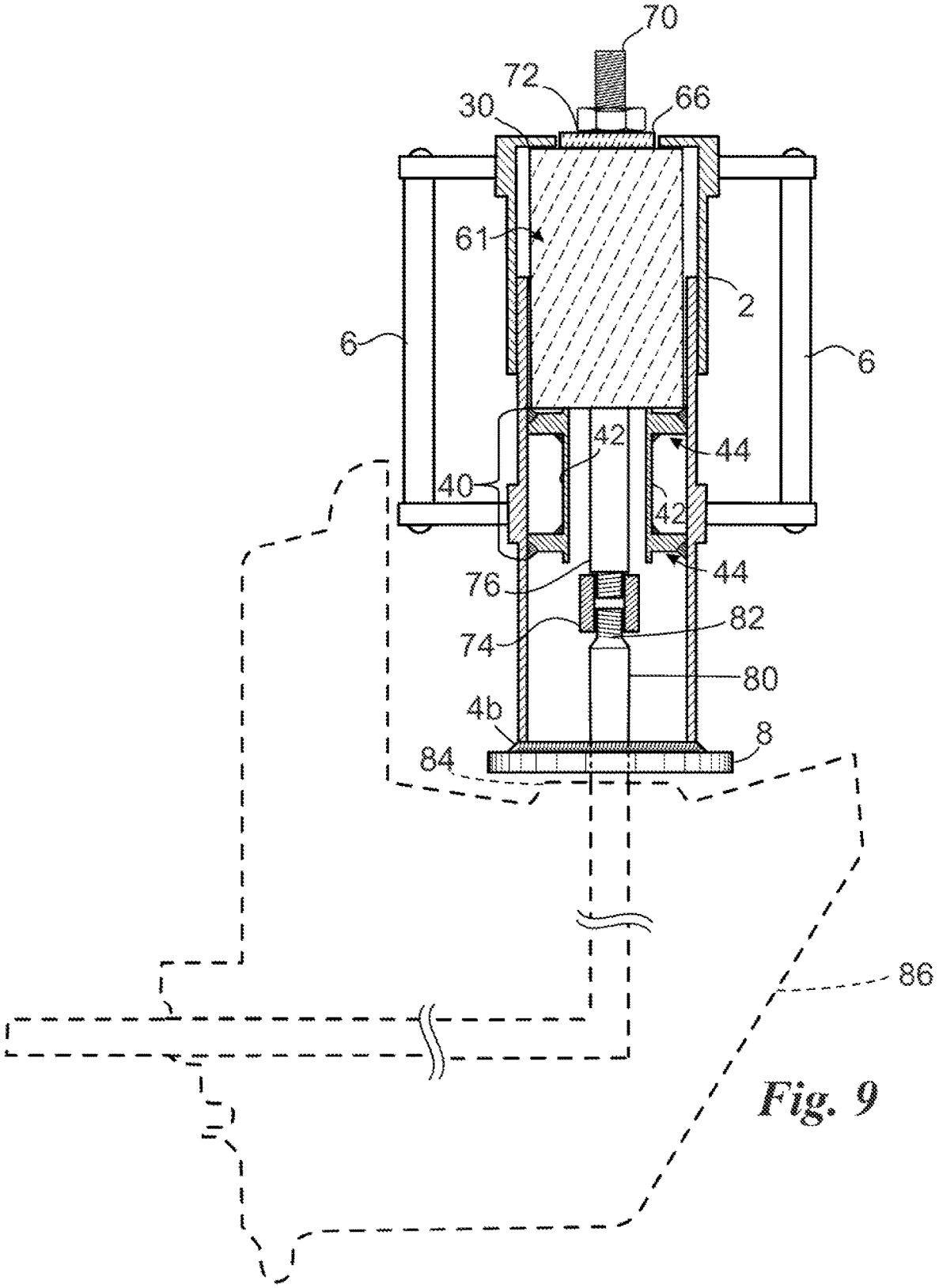
FIG. 9 shows a cross sectional view of an embodiment of the present invention during use.

Referring now to FIG. 9 the operation of the shown embodiment of the present invention will be described. One of the steps during use of the present invention is to attach a shaft coupler 74 to the shaft 80 to be removed. Typically shafts such as drive shafts and/or propeller shafts have a threaded end 82. Therefore, in at least one embodiment, the shaft coupler 74 comprises a threaded female to female type coupler having a threaded inner surface that may interconnect two shafts, each having at least one male type threaded end. Either before or after the shaft coupler 74 is attached to the shaft 80, the base 8 may be placed over the shaft 80 such that the base 8 sits on or adjacent to the circumference of the shaft opening 84 that is defined in the shaft/transmission housing 86. Once in place, an extension shaft 70 may be inserted into and through the hollow body jack 61 and through the internal guide conduit system 40. Once the extension shaft is in place, it may be connected to the shaft coupler 74. An extension rod securing member (also referred to as a shaft securing member) 72 may then be used to secure the extension shaft 70 to the jack's piston 66.

Once the present invention is in place and the shaft to be removed 80 is secured to the piston of the hollow body jack 61, the jack can be actuated by means of a power source, which may comprise a hydraulic hose (not shown) or and electric cord (not shown). Once actuated, the jack's piston 66 is rise upwardly through the jack opening 36 and above the cap and/or upper surface 30 of the upper housing. Because the extension shaft 70 is secured at a first end to the propeller shaft 80 by means of the coupler 74 and secured at a second end to the piston 66 by means of the extension rod securing member 72, actuation of the jack 61 will cause the piston to lift the propeller shaft 80, thus breaking any seal that has developed between the shaft 80 and the housing 86 and/or the shaft opening 84 defined in the housing.

Once the seal has been broken, the shaft securing member 72 may be removed from the extension shaft (also referred to as an extension rod) 70. Next, the present invention can be lifted up and off of the extension shaft and the propeller shaft 80 may be removed from the shaft opening 84 simply by pulling the extension shaft upwardly and away from the shaft opening.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An apparatus for removing a shaft from a transmission comprising:

a lower housing having a first end and a second end, wherein said lower housing includes an inner surface and an outer surface;

an upper housing having a first end and a second end, wherein said second end of said upper housing is carried by said first end of said lower housing and said first end of said upper housing defines a jack opening;

an inner guide conduit system carried by said inner surface of said lower housing, wherein said inner guide conduit system comprises:

a central conduit; and a support member having a first end that is carried by said central conduit and a second end that is carried by said inner surface of said lower housing;

a jack support chamber that is adapted to house a hollow body jack and is defined by at least a portion of said upper housing, a portion of said lower housing and a portion of said inner guide conduit system such that at least a portion of an upper surface of said upper housing is adjacent to an upper surface of the hollow body jack, at least a portion of said inner surface of said lower housing is adjacent to an outer surface of the hollow body jack and at least a portion of said inner guide conduit system is adjacent to a lower surface of the hollow body jack;

a viewing chamber that is disposed below said jack support chamber and is defined by at least a portion of said lower housing and at least a portion of said inner guide conduit system, wherein at least a portion of said lower housing includes a viewing window to provide access to said viewing chamber;

a base that includes a base opening adapted to receive a shaft to be removed; and whereby when said base is placed over the shaft to be removed, the shaft to be removed extends upwardly through said base opening and into said viewing chamber so that when the shaft to be removed is secured to the hollow body jack and the hollow body jack is actuated, said shaft to be removed is lifted.

2. The apparatus of claim 1 further comprising:

an extension rod that is adapted to be received by said jack opening in said upper housing and by said central conduit;

a shaft coupler that is adapted to receive and secure a first end of said extension rod to the shaft to be removed; and, an extension rod securing member that is adapted to receive and secure a second end of said extension rod to the hollow body jack; and whereby, when said extension rod securing member secures said extension rod to the hollow body jack and said extension rod is secured to the shaft to be removed and the hollow body jack is actuated, the hollow body jack lifts the shaft to be removed.

3. The apparatus of claim 1 wherein said support member of said inner guide conduit system comprises an inner support member and an outer support member wherein said inner support member is disposed at a point on said central conduit so that the distance between said inner support member and a midpoint of said central conduit is less than the distance between said outer support member and said midpoint of said central conduit.

4. The apparatus of claim 1 further comprising:

an upper housing notch defined in said upper housing and extending from said second end of said upper housing towards said first end of said upper housing;

a lower housing notch defined in said lower housing and extending from said first end of said lower housing towards said base; and wherein when said upper housing is carried by said lower housing, said upper housing notch and said lower housing notch align to create a port that is in fluid communication with said jack support chamber.

5. The apparatus of claim 4, wherein an outer surface of said upper housing includes a flat surface disposed adjacent to said upper housing port and extends around at least a portion of a perimeter of said upper housing notch.

6. The apparatus of claim 1 wherein said upper housing is carried by said lower housing such that an inner surface of said upper housing contacts said outer surface of said lower housing and when the hollow body jack is in said jack support chamber, the hollow body jack is in contact with said inner surface of said lower housing while being laterally spaced from an inner surface of said upper housing.

7. The apparatus of claim 1 wherein said jack opening is in fluid communication with said jack chamber and is adapted to allow a piston of the hollow body jack to extend outside of said jack support chamber.

8. The apparatus of claim 1 wherein said central conduit of said inner guide conduit system aligns with said jack opening such that said central conduit is disposed directly beneath said jack opening.

9. A shaft removal apparatus comprising:

a lower housing having a first end and a second end;

an upper housing having a first end and a second end, wherein said second end of said upper housing is carried by said first end of said lower housing and said first end of said upper housing defines a jack opening;

an inner guide conduit system carried by an inner surface of said lower housing, wherein said inner guide conduit system comprises:

a central conduit; and a support member having a first end that is carried by said central conduit and a second end that is carried by said inner surface of said lower housing;

a jack support chamber that is adapted to house a hollow body jack and is defined by at least a portion said upper housing, a portion of said lower housing and a portion of said inner guide conduit and is in fluid communication with said jack opening; and a base that includes a base opening adapted to receive a shaft to be removed such that the shaft to be removed extends upwardly through said base opening;

an extension rod that is adapted to be received by said jack opening in said upper housing and by said central conduit;

a shaft coupler that is adapted to receive and secure a first end of said extension rod to the shaft to be removed; and, an extension rod securing member that is adapted to receive and secure a second end of said extension rod to the hollow body jack; and whereby, said extension rod is secured to the shaft to be removed and said extension rod securing member secures said extension rod to a piston of the hollow body jack, so that when actuated, the hollow body jack lifts the shaft to be removed.

10. The apparatus of claim 9 further comprising a viewing chamber that is disposed below said jack support chamber and is defined by at least a portion of said lower housing and at least a portion of said inner guide conduit system, wherein at least a portion of said lower housing includes a viewing window to provide access to said viewing chamber.

11. The apparatus of claim 9 further comprising an upper housing notch defined in said upper housing and extending from said second end of said upper housing towards said first end of said upper housing a lower housing notch defined in said lower housing and extending from said first end of said lower housing towards said base; and wherein when said upper housing is carried by said lower housing, said upper housing notch and said lower housing notch align to create a port.

12. The apparatus of claim 11, wherein an outer surface of said upper housing includes a flat surface disposed adjacent to said upper housing notch and extends around at least a portion of a perimeter of said upper housing notch.

13. The apparatus of claim 9 wherein said upper housing is carried by said lower housing such that an inner surface of said upper housing contacts an outer surface of said lower housing and when the hollow body jack is in said jack support chamber, the hollow body jack is in contact with an inner surface of said lower housing while being laterally spaced from said inner surface of said upper housing.

14. The apparatus of claim 9 wherein said jack opening is in fluid communication with said jack support chamber and is adapted to allow said piston of the hollow body jack to extend outside of said jack support chamber.

15. The apparatus of claim 9 wherein said central conduit of said inner guide conduit system aligns with said jack opening such that said central conduit is disposed directly beneath said jack opening.

16. A method of removing a shaft from a transmission comprising:

providing a shaft removal apparatus comprising:

a lower housing having a first end and a second end;

an upper housing having a first end and a second end, wherein said second end of said upper housing is carried by said first end of said lower housing and said first end of said upper housing defines a jack opening;

an inner guide conduit system carried by an inner surface of said lower housing, wherein said inner guide conduit system comprises:

a central conduit; and a support member having a first end that is carried by said central conduit and a second end that is carried by said inner surface of said lower housing;

a jack support chamber that is adapted to house a hollow body jack and is defined by at least a portion said upper chamber, a portion of said lower chamber and a portion of said inner guide conduit system; and a base that includes an opening adapted to receive a shaft to be removed;

placing said hollow body jack in said jack support chamber;

placing said base over said shaft to be removed such that said shaft extends upwardly through said opening in said base;

securing the shaft to be removed to the hollow body jack; and, actuating the hollow body jack to lift the shaft to be removed.

17. The method of claim 16 further comprising the steps of:

inserting an extension rod through said jack opening, through said hollow body jack, and into said central conduit;

securing a first end of said extension rod to the shaft that is to be removed; and securing a second end of said extension rod to the hollow body jack so that when the hollow body jack is actuated, the extension rod is lifted, which causes the shaft to be removed to be lifted.

18. The method of claim 16 further comprising the step of providing an upper housing notch defined in said upper housing and extending from said second end of said upper housing towards said first end of said upper housing a lower housing notch defined in said lower housing and extending from said first end of said lower housing towards said base;

so that when said upper housing is carried by said lower housing, said upper housing notch and said lower housing notch align to create a port.

* * * * *